US006615521B1

(12) United States Patent
Lutz

(10) Patent No.: US 6,615,521 B1
(45) Date of Patent: Sep. 9, 2003

(54) OUTDOOR ELECTRICAL DISPLAY SIGN WITH AN ELECTRICAL RESISTANCE HEATER

(75) Inventor: Robert J. Lutz, Bruce, SD (US)

(73) Assignee: Daktronics, Inc., Brookings, SD (US)

( * ) Notice: Subject to any disclaimer, the term of this patent is extended or adjusted under 35 U.S.C. 154(b) by 0 days.

(21) Appl. No.: 09/736,510

(22) Filed: Dec. 13, 2000

(51) Int. Cl.[7] ..... G09E 7/00
(52) U.S. Cl. ..... 40/584; 40/564
(58) Field of Search ..... 40/606, 584, 612, 40/564, 578

(56) References Cited

U.S. PATENT DOCUMENTS 3,783,242 A * 1/1974 Barnard ..... 174/84 C
4,137,447 A * 1/1979 Boaz ..... 219/522
4,952,783 A * 8/1990 Aufderheide et al. ..... 219/528
4,958,905 A * 9/1990 Tynes et al. ..... 385/96
5,099,250 A * 3/1992 Paulus et al. ..... 343/704
5,353,536 A * 10/1994 Erber et al. ..... 40/611
5,471,775 A * 12/1995 Hoyt et al. ..... 40/601
5,750,267 A * 5/1998 Takase et al. ..... 219/522
5,769,534 A * 6/1998 Lewis ..... 40/574
5,854,708 A * 12/1998 Komatsu et al. ..... 359/507
5,933,119 A * 8/1999 Fujii et al. ..... 343/704
5,953,842 A * 9/1999 Bodell ..... 40/574
5,983,543 A * 11/1999 Hillstrom ..... 40/611
6,160,495 A * 12/2000 Demink et al. ..... 40/541

* cited by examiner

*Primary Examiner*—D. Glenn Dayoan
*Assistant Examiner*—Lori L Coletta
(74) *Attorney, Agent, or Firm*—Hugh D. Jaeger

(57) ABSTRACT

An outdoor electrical display sign with an electrical resistance heating element on a transparent front panel thereof for removing condensation or for dissipating precipitation from the surfaces of the transparent front panel of the sign. The electrical resistance heating element can be adhesively secured onto a surface of the transparent front panel, taped onto a surface of the transparent front panel, laminated between the transparent front panel and an additional transparent polymer panel, photoscreened onto a surface of the transparent front panel, photo-etched onto a surface of the transparent front panel, or formed by pouring electrical resistance material into minute grooves formed in the transparent front panel. The electrical resistance heating element can be on either the inner surface or the outer surface of the transparent front panel, preferably the inner surface.

5 Claims, 5 Drawing Sheets

OUTDOOR ELECTRICAL DISPLAY SIGN WITH AN ELECTRICAL RESISTANCE HEATER

CROSS REFERENCES TO RELATED APPLICATIONS

None.

BACKGROUND OF THE INVENTION

1. Field of the Invention

The present invention is for an outdoor electrical display sign, such as an LED or reflective sign, and more particularly, pertains to an outdoor electrical matrix display sign having an electrical resistance heating element on the transparent front panel of the sign, such as on the inside surface of the transparent front panel, for heating the surface of the transparent front panel for vaporizing of condensation or dissipating precipitation.

2. Description of the Prior Art

Prior art large outdoor electrical matrix display signs, such as signs at sporting events, shopping malls, and highway signs, have the propensity to have condensation buildup on the inside surface of the transparent front panel, such as for LED displays or reflective displays. This impairs the visibility of the display. Also, precipitation (e.g., sleet (ice), rain, snow, mist, frost) on the exterior surface of the transparent front panel impairs visibility of the display. In the past, it has been one practice to utilize an electrical resistance heater circulating hot air through the inside of the electrical sign for eliminating condensation or precipitation, but this reduces circuitry reliability.

The present invention overcomes the disadvantages of the prior art by providing an electrical resistance heating element on a surface of the transparent front panel of a large outdoor electrical matrix display sign.

SUMMARY OF THE INVENTION

The general purpose of the present invention is to provide a large outdoor electrical matrix display sign, such as an LED or reflective display contained within a housing which has a transparent front panel, generally formed of a transparent polymer, such as methyl methacrylate sold under the registered trademark PLEXIGLAS®, with an electrical resistance heating element on the transparent front panel for eliminating condensation or dissipating precipitation from the transparent front panel. The electrical resistance heating element is adhesively secured onto or taped onto a surface of the transparent front panel, is laminated between the transparent front panel and an additional transparent polymer panel, is photoscreened or photo-etched onto a surface of the transparent front panel, or is formed by pouring electrical resistance material into minute grooves, such as V-grooves, formed in a surface of the transparent front panel, and is subsequently energized from an electrical power source, such as a low voltage direct current power source. The surface of the transparent front panel to which the electrical resistance heating element is applied may be either the inner surface or the outer surface.

According to one embodiment of the present invention, there is provided a large outdoor electrical display sign, which includes a housing, electrical display circuitry inside the housing, and a transparent polymer front panel over the display, the display being an LED, a reflective, or other electrical display device. An electrical resistance heating element is applied to the interior surface of the transparent front panel, such as by taping on or adhesively securing an electrical resistance heating element, by laminating the electrical resistance heating element between the transparent front panel and an additional transparent polymer panel, by photo-etching or photoscreening on an electrical resistance heating element, or by cutting minute grooves in the interior surface of the transparent front panel and then depositing an electrical resistance material. The electrical resistance heating element connects to a suitable electrical power source, such as a low voltage direct current source, such as a 12 volt direct current.

One significant aspect and feature of the present invention is an electrical resistance heating element on the interior surface of the transparent front panel of a large outdoor electrical matrix display sign to vaporize or dissipate any condensation or precipitation, such as a light coating of water vapor.

Having thus described embodiments and significant aspects and features of the present invention, it is the principal object of the present invention to provide a large outdoor electrical matrix display sign with an electrical resistance heating element on the transparent front panel thereof for eliminating condensation or dissipating precipitation.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
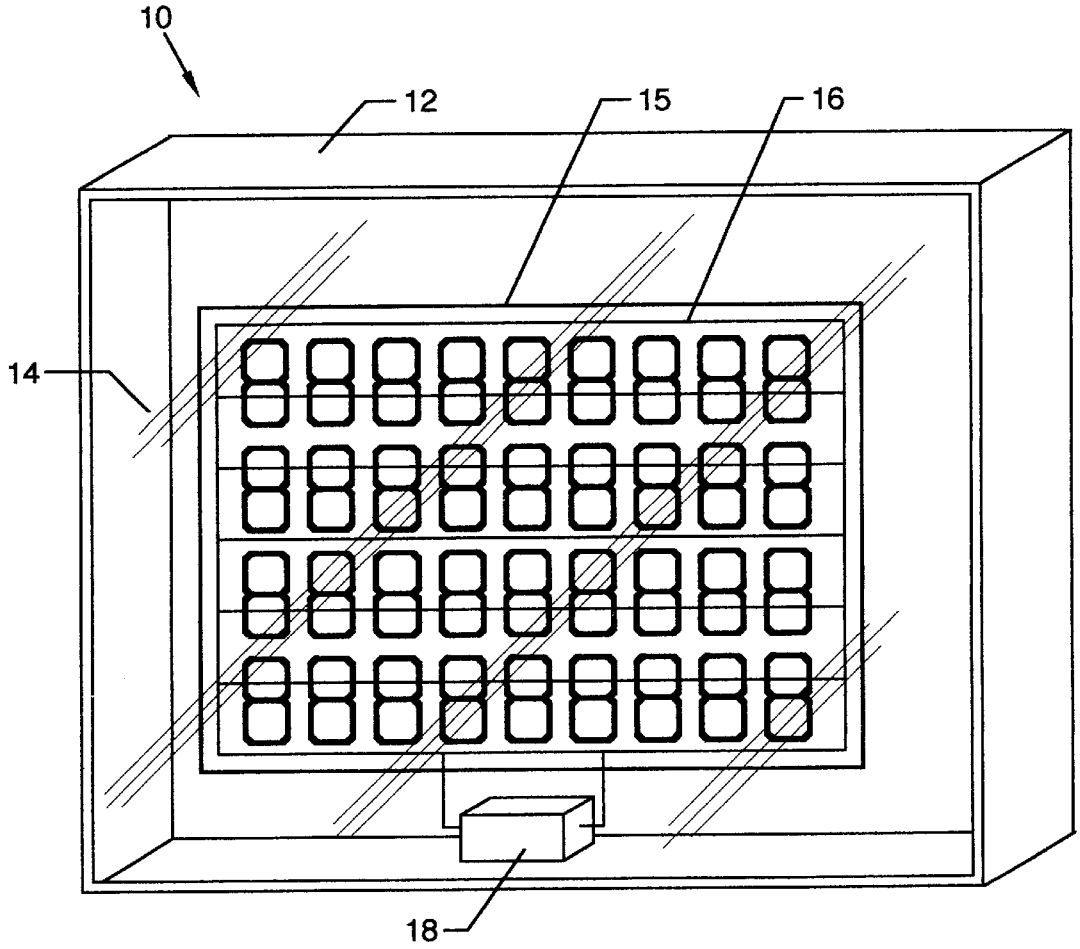
FIG. 1 illustrates an isometric view of a large outdoor electrical matrix display sign with a transparent polymer front panel and an electrical resistance heating element on a surface of the transparent front panel.

FIG. 1 illustrates a sign 10 which includes a housing 12 having a transparent front panel 14 generally made of a transparent polymer, such as methyl methacrylate sold under the registered trademark PLEXIGLAS®, and an electrical display 15 located rearwardly from and viewable through the transparent front panel 14. An electrical resistance heating element 16 located forwardly from the electrical display 15 connected to a DC power supply 18 is either adhesively secured onto a surface of the transparent front panel, taped onto a surface of the transparent front panel, photo-etched or photoscreened onto a surface of the transparent front panel, or formed by pouring electrical resistance material into minute grooves formed in the transparent front panel. The electrical resistance heating element 16 may also be laminated between the transparent front panel 14 and an additional transparent polymer panel 24 with or without the use of an adhesive 26, as described and illustrated with reference to FIGS. 3 and 4.

Figure 2:
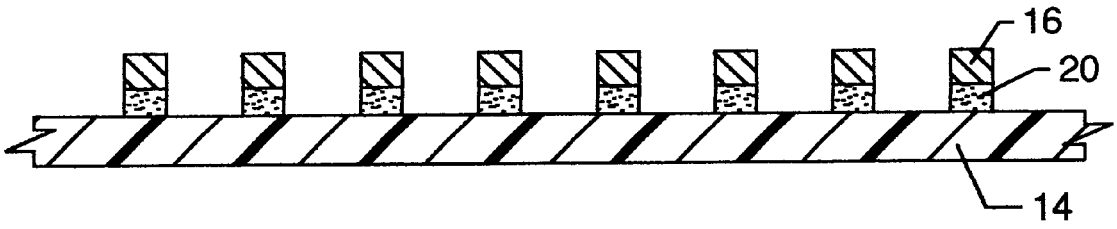
FIG. 2 illustrates a magnified cross section of the transparent polymer front panel with an electrical resistance heating element secured to a surface of the transparent front panel with adhesive.

FIG. 2 illustrates a magnified cross section of a transparent front panel 14 with an electrical resistance heating element 16 secured thereto by adhesive 20. The electrical resistance heating element 16 can be secured to either the inside surface or the outside surface of the transparent front panel 14, but is preferably secured to the inside surface.

Figure 3:
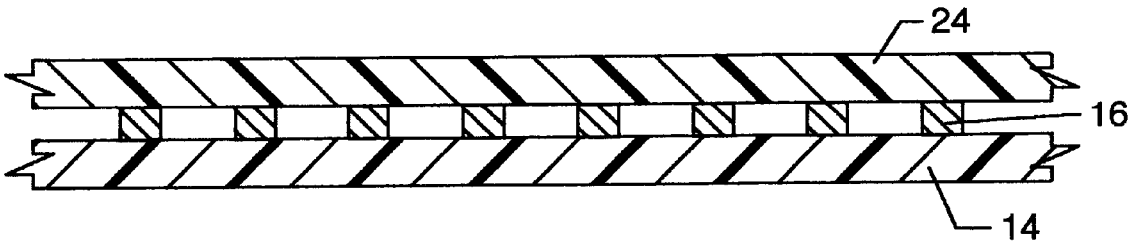
FIG. 3 illustrates a magnified cross section of the electrical resistance heating element laminated between the transparent front panel and an additional transparent polymer panel, the first alternative embodiment.

FIG. 3 illustrates a magnified cross section of the electrical resistance heating element 16 laminated between the transparent front panel 14 and an additional transparent polymer panel 24, the first alternative embodiment.

Figure 4:
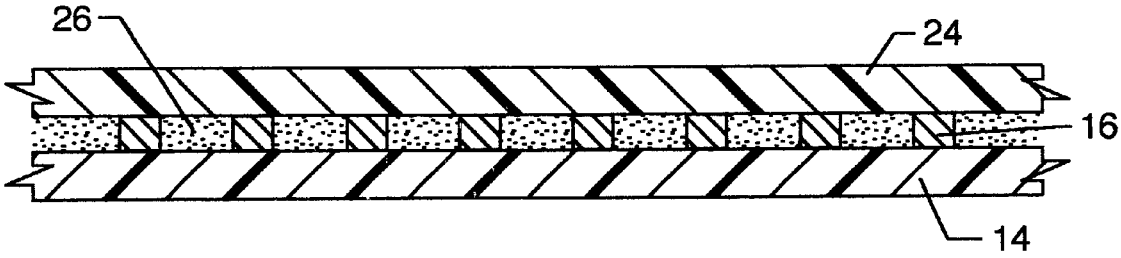
FIG. 4 illustrates a magnified cross section of the electrical resistance heating element laminated between the transparent front panel and an additional transparent polymer panel using an adhesive, the second alternative embodiment; and, FIG. 5 illustrates a magnified cross section of a transparent front panel with minute grooves, shown as V-grooves, containing electrical resistance material which forms the electrical resistance heating element , the third alternative embodiment.

FIG. 4 illustrates a magnified cross section of the electrical resistance heating element 16 laminated between the transparent front panel 14 and an additional transparent polymer panel 24 using an adhesive 26, the second alternative embodiment. The electrical resistance heating element 16 is laminated between the transparent front panel 14 and an additional transparent polymer panel 24 using an adhesive 26 to bond the electrical resistance heating element 16 between the transparent front panel 14 and the transparent polymer panel 24 to achieve solidarity.

Figure 5:
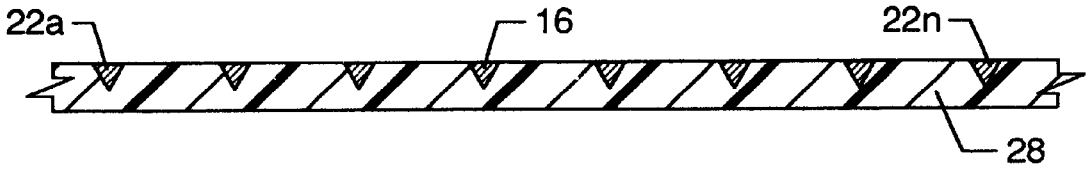

FIG. 5 illustrates a magnified cross section of a transparent front panel 28 with minute grooves 22*a*–22*n* containing electrical resistance material which forms the electrical resistance heating element 16, the third alternative embodiment. The grooves 22*a*–22*n* containing electrical resistance material can be formed either in the interior surface of the transparent front panel 28 or in the exterior surface of the transparent front panel 28, but are preferably formed in the interior surface. The grooves 22*a*–22*n* are shown as V-shaped, but the grooves 22*a*–22*n* need not be V-shaped; any suitably shaped grooves may be utilized. The grooves 22*a*–22*n* can be provided in any suitable pattern or arrangement, one suitable pattern or arrangement being a serpentine configuration.

Various modifications can be made to the present invention without departing from the apparent scope hereof.

OUTDOOR ELECTRICAL DISPLAY SIGN WITH AN ELECTRICAL RESISTANCE HEATER

PARTS LIST

10 sign
12 housing
14 transparent front panel
16 electrical resistance heating element
18 DC power supply
20 adhesive
22*a*–*n* grooves
24 transparent polymer panel
26 adhesive
28 grooved transparent front panel

What is claimed is:

1. An outdoor sign comprising:

a. a housing;

b. an electrical display located inside said housing;

c. a transparent front panel forming a front portion of said housing, said electrical display being viewable through said transparent front panel; and, d. an electrical resistance heater on a surface of said transparent front panel for eliminating condensation or dissipating precipitation from said transparent front panel, said electrical resistance heater comprising a plurality of strips of electrical resistance material affixed to said surface of said transparent front panel.

2. The outdoor sign of claim 1, wherein said surface of said transparent front panel to which said electrical resistance material is affixed is the inside surface of said transparent front panel.

3. An outdoor sign comprising:

a. a housing;

b. an electrical display located inside said housing;

c. a transparent front panel forming a front portion of said housing, said electrical display being viewable through said transparent front panel;

d. a plurality of minute grooves formed in a surface of said transparent front panel; and, e. an electrical resistance heater on said transparent front panel for eliminating condensation or dissipating precipitation from said transparent front panel, said electrical resistance heater comprising electrical resistance material deposited in said minute grooves.

4. The outdoor sign of claim 3, wherein said surface of said transparent front panel in which said plurality of minute grooves are formed is the inside surface of said transparent front panel.

5. The outdoor sign of claim 3, wherein said plurality of minute grooves have a serpentine configuration.

* * * * *